United States Patent [19]

Bahr

[11] 4,120,122

[45] Oct. 17, 1978

[54] ROOF EDGE AND WALL CAP AND ANCHOR

[76] Inventor: Norman Bahr, P.O. Box 1845, Grand Island, Nebr. 68801

[21] Appl. No.: 826,983

[22] Filed: Aug. 23, 1977

[51] Int. Cl.[2] ..... E04D 13/00; E04B 1/38

[52] U.S. Cl. ..... 52/58; 52/94; 52/300; 52/715

[58] Field of Search ..... 52/58–62, 52/94–96, 300, 712–715

[56] References Cited

U.S. PATENT DOCUMENTS

| | | | |
|---|---|---|---|
| 2,181,698 | 11/1939 | Langenberg | 52/715 X |
| 2,929,237 | 3/1960 | Lancer | 52/60 |
| 3,673,748 | 7/1972 | Minialoff | 52/60 |
| 3,719,010 | 3/1973 | Hickman | 52/60 |
| 3,735,540 | 5/1973 | Thaler | 52/96 X |
| 3,782,058 | 1/1974 | Allen | 52/300 |
| 3,802,140 | 4/1974 | Hickman | 52/300 |
| 3,862,531 | 1/1975 | Attaway et al. | 52/300 |

FOREIGN PATENT DOCUMENTS

| | | | |
|---|---|---|---|
| 553,477 | 2/1958 | Canada | 52/300 |
| 1,240,911 | 8/1960 | France | 52/715 |
| 1,356,256 | 6/1974 | United Kingdom | 52/60 |

*Primary Examiner*—J. Karl Bell

*Attorney, Agent, or Firm*—Sherman & Shalloway

[57] ABSTRACT

A parapet and eave cap assembly and anchor are disclosed in which a corrugated sheet metal tie is incorporated in the wall and includes a split-end having tabs which are bendable to conform in angle to a desired slope of a plate forming a part of an inverted U-shaped cover frame. The plate includes slots for receiving the anchor upwardly therethrough and has outer and inner legs of selected elevation to provide the desired slope in the cap assembly. The tabs of the anchor are simply bent over in opposite directions upon the surface of the plate and are thereafter nailed in place to provide a tensioning anchor between the masonry wall and the cover frame of the cap assembly. The cap assembly is finished by means of a suitable metal flashing overlying the assembly and adjacent edges of flashing strips or similar portions of the roof structure. The cover frame of the cap assembly preferably is made of wood or an equivalent material which will receive fasteners for securing the metallic flashing cap on the cap assembly.

8 Claims, 5 Drawing Figures

FIG. 1
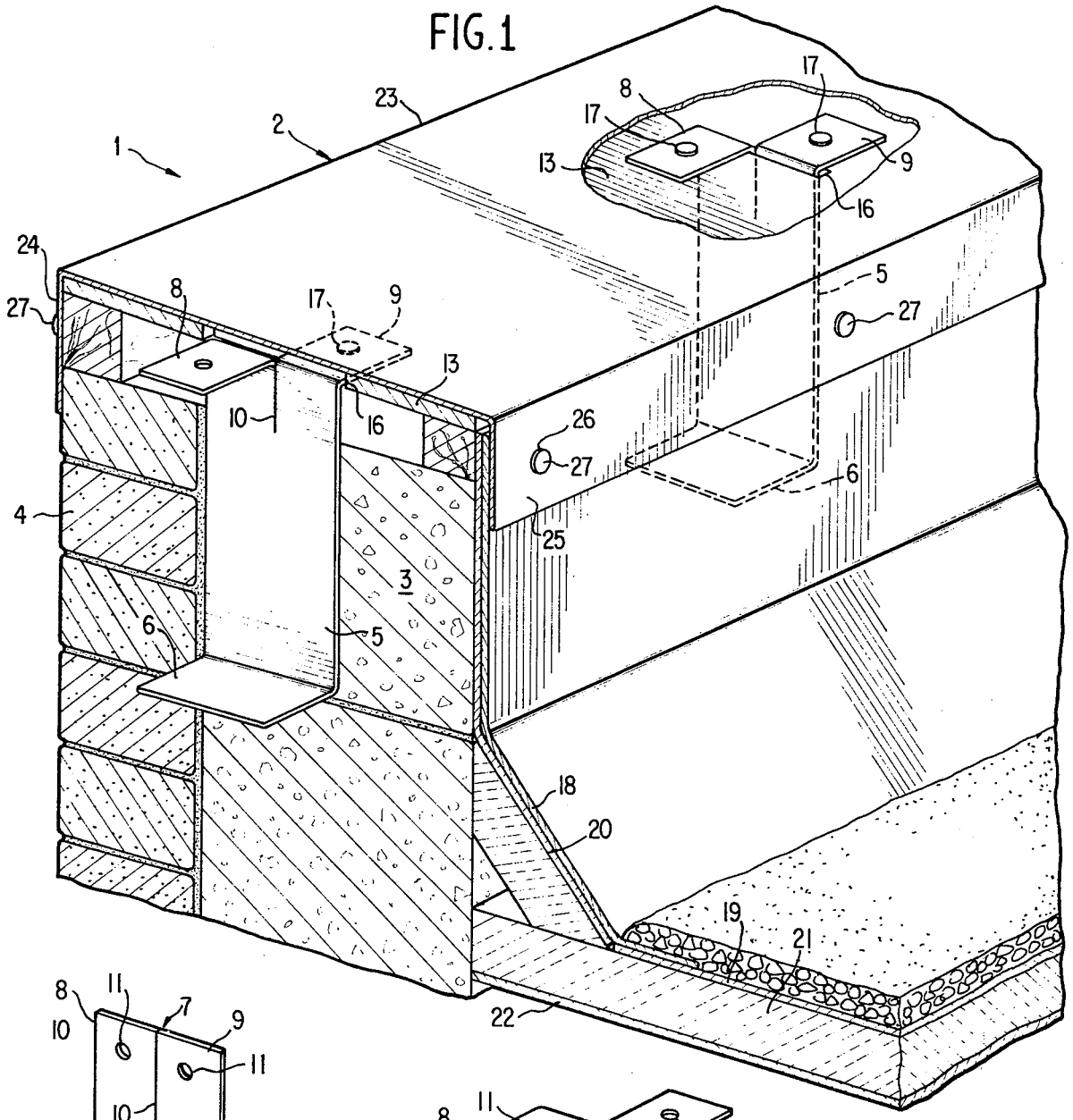
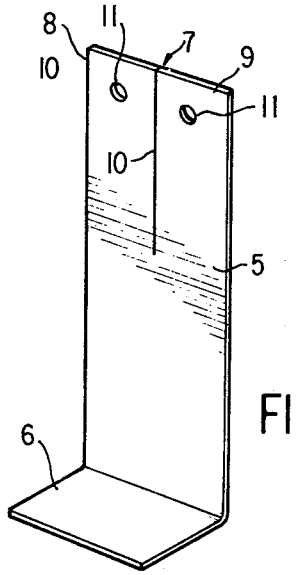
FIG. 3
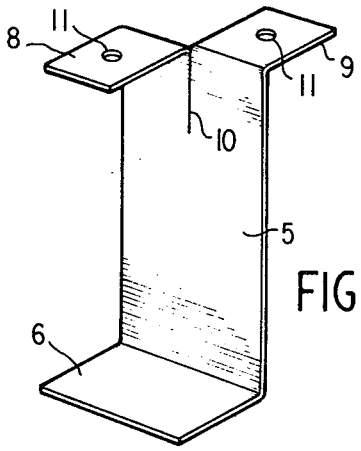
FIG. 3A

ROOF EDGE AND WALL CAP AND ANCHOR

BACKGROUND OF THE INVENTION

The present invention relates to cap assemblies and anchors for roof edges and wall protection, and is concerned more particularly with composite, built-up cap assemblies for walls and roof edges which are anchored in the wall by anchors which are readily modified to accomodate not only the desired slope or alignment of the cap assembly, but also any minor variations in the alignment of the cap with regard to the wall.

BRIEF DESCRIPTION OF THE PRIOR ART

A wide variety of attempts have been made in the provision of protective and sealing caps or copings for closure of the upper portion of a masonry wall with adjacent roof areas. Typically, however, these attempts have been contigent upon the embedment of anchor bolts in the masonry wall to anchor a base plate or beam to the upper surface of the wall for carrying the remainder of the structure. U.S. Pat. No. 2,857,861 to Trostle and U.S. Pat. No. 3,719,010 to Hickman are examples of this prior approach. Both these prior structures incorporate extruded cap members which are secured onto the base beam by means of anchoring screws. Special fold-over lips or locking channels are provided in the extruded members to accomodate the edge of the adjacent roofing material.

Such prior structures which rely upon threaded anchor bolts secured within the wall are prone to a great deal of difficulty as a consequence of uneven alignment, bending, rusting, or thread-obstruction by mortar and the like. When the misalignment is severe, such bolts may require cutting and rethreading, rebending or even resetting in order to provide the necessary tension between the masonry wall and the anchoring beam of the cap assembly. In many cases, regardless of the care with which such anchor bolts are set, they have been found to be prone to loosening within the wall to the point where the head of the bolt no longer is positively engaged so that the entire bolt will rotate when an attempt is made to secure a locking nut to the bolt.

Furthermore, when wooden beams of substantial cross-sectional area are employed as anchoring beams, they are subject to warping and distortion, particularly when they experience changing conditions of rain and sunshine prior to their enclosure by the cap assembly. Additionally, many prior systems have relied upon a tapering of the planking or beam in order to provide the necessary slope for the cap assembly to divert rain water in the desired direction. Accordingly, it has been quite expensive to mill the taper in; for example, 3 × 8 inches or larger cap beams. Where extrusions are used, of course, they may be formed to accomodate a standard, rectangular beam; but the cost of the special interlocks, folding flaps, and the like of such extrusions more than compensate for the cost of milling of special cross-section beams. In addition, cap systems which rely upon such extrusions necessarily require a special unit or a special extrusion for each width of wall.

Therefore, prior cap assemblies and anchors have not been found to be entirely satisfactory.

SUMMARY AND OBJECTS OF THE INVENTION

In general, the preferred form of the present invention comprises a built-up cap assembly including an inverted U-shaped cover frame secured by sheet metal anchors which are embedded in the wall to be capped and which include upwardly-extending split ends for protrusion through a plate in the cover frame for bending in comformity with the slope of the cover frame and securement of the cover frame against the upper surface of the wall, the assembly being completed by a flashing cap secured to the cover frame.

It is an object of the present invention to provide a simple, economical, but reliable wall cap and anchor for walls.

It is another object of the present invention to provide an economical and reliable wall cap which requires a minimum of resetting or adjustment time with regard to anchors which are embedded in the wall.

It is another object of the present invention to provide an economical and reliable wall cap and an anchor therefore which is capable of being adjusted to the particular slope and elevation of the cap assembly at its point of engagement.

It is another object of the present invention to provide an economical and reliable wall cap which incorporates substantially standard lumber and which provides for establishment of a desired slope by the simple ripping of said standard lumber at the desired angle.

It is a further object of the present invention to provide an economical and reliable wall cap which may be anchored without embedment of threaded anchor bolts within the wall.

It is a further object of the present invention to provide an economical and reliable wall cap which will readily accomodate variations in the contour of the wall surface.

It is a particular object of the present invention to provide an anchor for wall caps which is capable of being embedded within the wall and is further capable of accomodating both variations in depth between the point of embedment and the point of engagement with the cap and the selected slope of the cap assembly.

It is a further object to incorporate a flexible seal along the inverted "U" section for greater conformity and preventing air infiltration into the building.

It is a further particular object of the present invention to provide an anchor for embedment in a wall and which is capable of substantially infinite accomodation of slope of the cap assembly.

BRIEF DESCRIPTION OF THE DRAWINGS

These and other objects of the invention and and better understanding thereof may be derived from the following description and the accompanying drawings in which:

FIG. 1 is a perspective, partly cut-away view of a preferred form of parapet cap and anchor of the present invention;

FIG. 3 is a prespective view of the preferred form of anchor prior to its embedment and assembly;

FIG. 3A is a view similar to FIG. 3 and showing the manner of securement of the upper end of the anchor with the cap assembly;

Figure 4:
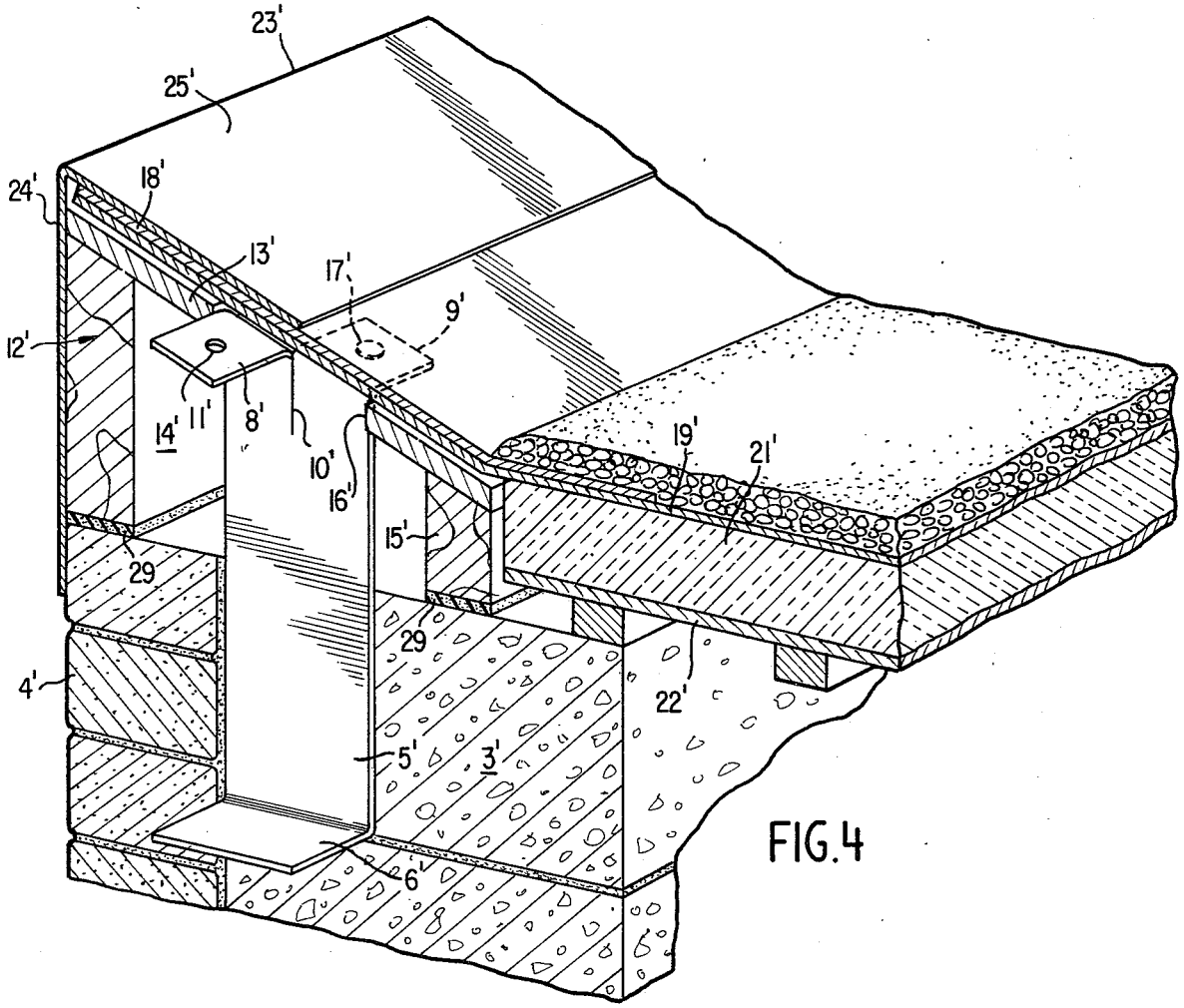

and, FIG. 4 is a view to similar to FIG. 1 showing a modified form of the invention for use as an eave cap.

DETAILED DESCRIPTION OF THE PREFERRED EMBODIMENT

As shown in FIGS. 1 through 3A, the preferred form of the present invention is embodied in a parapet cap assembly 2 at a roof edge 1 which is formed by a masonry wall 3 including a suitable facing 4 of brick. An anchor 5 having a base leg 6 is embedded in the masonry wall at a suitable joint portion and extends upwardly therefrom to terminate in a split end 7 having a slit 10 separating a pair of tabs 8 and 9. If desired, the more extreme portions of the tabs 8 and 9 may be provided with apertures 11 as will be discussed more fully hereinafter.

Figure 2:
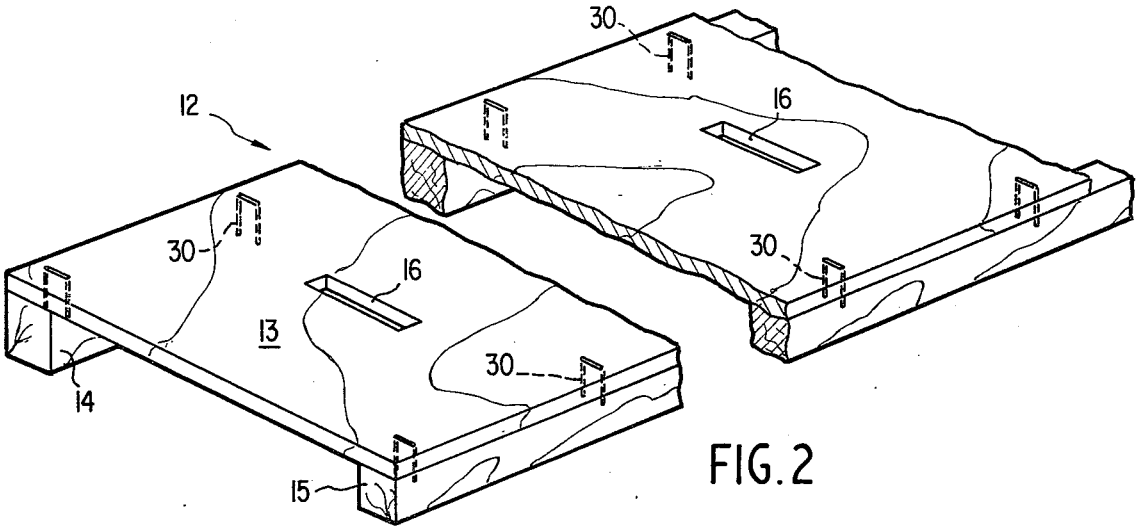
FIG. 2 is a perspective view of the cover frame of FIG. 1.

As best shown in FIG. 2, a stapled or suitably nailed cover frame assembly 12 comprising a base plate 13 and parallel supports 14 and 15 located along its outer edges is provided with a plurality of transverse slots 16 spaced at intervals to receive the split ends 7 of the anchors upwardly therethrough. With the cover frame 12 positioned on the upper portion of the wall and with the split ends of the anchors projecting upwardly through the slots 16, the tabs 8 and 9 are then simply hammered over to conform to the upper surface of the base plate 13 and are then nailed in that position by means of the apertures 11 and suitable nails 17. Advantageously, bituminous flashing strips 18 are positioned along the edge support 15 of the cover frame 12 and extend downwardly therefrom to overlie bituminous roofing sheets 19. A cant plate 20 preferably is installed under the bituminous flashing strips to reduce the acuteness of the angle between the side of the wall and the roof. The roof may take conventional form or structure such as the insulating layer 21 and deck 22 shown in FIG. 1.

After assembly of the cover frame upon the wall, bending or dogging of the several tabs 8 or 9, and installation of the bituminous flashing strips, the assembly is then covered by a generally U-shaped cap 23 having an outer leg 24 depending below the joint of the wall with the cover frame and an inner leg or flange 25 extending below the cover frame a distance sufficient to provide for clamping of the bituminous flashing sheet thereagainst upon its securement on the cover frame by means of suitable fasteners such as the gasketed fasteners 27 shown which may be either introduced through apertures 26 in the u-shaped cap or may be driven through the flashing metal from which the cap is formed. The wooden support 15 allows the roof workmen to positively anchor the bituminous flashing sheet to the wall with conventional roofing nails.

Therefore, it is apparent that the preferred form of the present invention provides for an unusually simple assembly and installation of a parapet cap without the need for accomodation of variations in anchor-set within the wall or variations in the line of the upper surface of the wall.

As shown in FIG. 4, the preferred form of the present invention is shown as a cap for roof eaves and the same numerals, primed, are used to denote elements similar to those used in FIGS. 1 through 3A. The structure of the cap shown in FIG. 4 is generally similar to that shown in FIGS. 1 through 3A, but is modified to provide for a raised roof edge, in the absence of the upstanding wall encountered with the parapet edge of FIG. 1.

Accordingly, the outer support 14' and inner support 15' of the cover frame 12' are of considerably greater depth than those used in the cap of FIG. 1 and their upper surfaces are formed at a considerably steeper angle than those of the supports of FIG. 1. The cap plate 24' is generally V-shaped to extend an outer flange 24' downwardly below the joint of the cover frame with the upper surface of the wall and to provide an inner flange 28 extended inwardly substantially parallel to the upper surface of the base plate 13' of the cover frame. FIG. 4 also shows an alternative form of engagement between the supports 14' and 15' with the upper surface of the wall in that a foamed sealing strip 29 may be positioned between the upper surface of the wall and the engaging surfaces of the supports 14' and 15'. The remaining structure of the form of the invention disclosed in FIG. 4 is similar to the corresponding structure in FIG. 1.

In both forms of the invention, it is to be understood that the cover frame 12 or 12' may be assembled by means of staples 30, as shown, or may be nailed, glued, or otherwise assembled by any desired means. It is important to note, however, that the formation of the angularity on the upper surfaces of the supports which dictate the angularity of the base plate is a simple matter of ripping standard lumber at the desired angle. For example, a piece of lumber of nominal dimension commonly known as "two by eight" may be ripped lengthwise to provide two supports of dissimilar depth and of proper surface angle simply by tilting of the ripping bed in relation to the saw blade. Therefore, the prior art requirement of planing the flat side of the lumber at an angle to provide the requisite slope has now been replaced by a much more simple and much less costly rip-sawing of conventional lumber. The base plate 13 may be formed off plywood or any other desired material. Accordingly, the present invention provides the option of either forming the cover frames 12 in uniform lengths at a factory, or forming the base plate and its ripped supports into the desired lengths of cover frames at the site. With provision for off-setting the pieces 14, 15 and cover 13, they may be interlocked together for greater strength and level base for cover 27.

In addition, it is apparent that the present invention provides a further convenience and simplicity in its use of a sheet metal anchor whose working, bending, cutting or nailing is well known to the ordinary workman. For example, corrugated and galvanized sheet metal of about 12 guage may be formed into the "L" shape shown in FIG. 3 with its upper end pre-slit to form the two tabs. Alternatively, the cut or slit may be made, enlarged, or modified by means of hand shears at the site of installation. Similarly, any required trimming of corners or edges may be easily affected by the average workman without the need for special tools such as acetylene torches and the like.

If desired, in addition to the foamed sealing strips 29, which provide a seal between the relatively straight edge of the lumber and the rough upper surface of the wall, other desired forms of insulation may be used with the new wall cap of the present invention. Although the foamed material sealing strips 29 are particularly advantageous in providing for accomodations of irregularities in the wall surface and sealing against air leakage, it is to be understood that sealing strips formed of other materials may be used.

Therefore, the present invention provides a particularly advantageous, built-up wall cap which not only is suitable for use with parapets, but is also quite readily used to form a raised outer lip about the periphery of substantially flat roofs. This not only provides for drainage protection and a deterrent to the drying out or deterioration of the bituminous roofing material but also prevents slopping of the bituminous binder onto the exterior of the surface of the building, as might occur without the preferred raised edge, while providing this most advantageous structure without the need for extruded shapes or the adjusting and changes which are so often encountered with the use of anchor bolts.

Various changes may be made in the details of the invention as disclosed without sacrificing the advantages thereof or departing from the scope of the appended claims.

What is claimed is:

1. A cap assembly for walls comprising
a U-shaped cover frame having
a generally planar base portion and
a pair of supports forming the legs of the U-shaped cover frame
at lest one aperture in said base portion
means for anchoring said cover frame to a wall including an anchor member having
a bottom portion adapted for embedment in a wall and a split end adapted to extend upward from the wall through said aperture in said base portion, and
said split end of said anchor member being formed of a bendable sheet metal whereby said split ends may be bent over onto a surface of said base portion for securement thereon.

2. The cap assembly of claim 1 in which said pair of supports extend downwardly from said base portion and including a cover cap over said frame.

3. The cap assembly of claim 2 in which said supports are unequal in depth from said base portion.

4. The cap assembly of claim 3 including a sealing strip adjacent the lower edge of said supports.

5. The cap assembly of claim 4 in which said sealing strip is formed of a foamed material.

6. The cap assembly of claim 3 in which the aperture in said base portion is a slot and the split end of said anchor is formed of a generally flat strip of sheet metal.

7. The cap assembly of claim 3 in which said anchor is formed of a strip of sheet metal and includes a base leg at its end opposite from said split end, and said aperture in said base portion is a slot alignable with said split end.

8. The cap assembly of claim 5 in which said anchor member is formed of a strip of corrugated sheet metal.

* * * * *